US008662779B2

(12) United States Patent
deVirag et al.

(10) Patent No.: US 8,662,779 B2
(45) Date of Patent: Mar. 4, 2014

(54) SPREADABLE FLUID MATERIAL DISPENSER APPARATUS

(75) Inventors: Francis Kiss deVirag, Kirtland Hills, OH (US); Ileen Rosner, Novelty, OH (US); Jonathan Rosner, Novelty, OH (US)

(73) Assignee: Innovation Consumer Solutions, LLC, Novelty, OH (US)

( * ) Notice: Subject to any disclaimer, the term of this patent is extended or adjusted under 35 U.S.C. 154(b) by 728 days.

(21) Appl. No.: 12/182,259

(22) Filed: Jul. 30, 2008

(65) Prior Publication Data

US 2009/0028629 A1 Jan. 29, 2009

Related U.S. Application Data

(63) Continuation-in-part of application No. 11/847,257, filed on Aug. 29, 2007.

(60) Provisional application No. 60/823,855, filed on Aug. 29, 2006, provisional application No. 60/823,857, filed on Aug. 29, 2006, provisional application No. 60/823,860, filed on Aug. 29, 2006, provisional application No. 60/823,864, filed on Aug. 29, 2006, provisional application No. 60/823,866, filed on Aug. 29, 2006, provisional application No. 60/823,869, filed on Aug. 29, 2006.

(51) Int. Cl.
*B05C 11/00* (2006.01)

(52) U.S. Cl.
USPC ..... 401/175; 401/132; 401/265; 401/266

(58) Field of Classification Search
USPC ..... 401/172, 174, 175, 265, 266, 164, 132, 401/152, 5, 140
See application file for complete search history.

(56) References Cited

U.S. PATENT DOCUMENTS

| | | | | |
|---|---|---|---|---|
| 4,921,130 | A * | 5/1990 | Hollberg | 222/46 |
| 5,890,630 | A * | 4/1999 | Lobdell | 401/266 |
| 6,022,163 | A | 2/2000 | Asfur | |
| 6,752,157 | B2 | 6/2004 | Hua | |
| 6,957,925 | B1 | 10/2005 | Jacobs et al. | |
| 2005/0025560 | A1 | 2/2005 | Liberatore | |
| 2005/0135869 | A1 * | 6/2005 | Liberatore | 401/266 |
| 2008/0131191 | A1 | 6/2008 | deVirag et al. | |

OTHER PUBLICATIONS

International Search Report for PCT/US07/77159 dated Apr. 11, 2008.

International Search Report corresponding to U.S. Appl. No. 12/182,259 mailed on Sep. 4, 2009.

* cited by examiner

*Primary Examiner* — Gregory Huson
*Assistant Examiner* — Bradley Oliver
(74) *Attorney, Agent, or Firm* — Turocy & Watson, LLP

(57) ABSTRACT

A dispenser for fluid material that facilitates spreading of the fluid material is disclosed. The dispenser can comprise a unitary construction, or can be composed of a plurality of components that can be fastened together. Disposable cartridges containing fluid material can be attached to the dispenser, and the material within can be dispensed on a surface. The dispenser provides metered dispensing.

17 Claims, 8 Drawing Sheets

SPREADABLE FLUID MATERIAL DISPENSER APPARATUS

CROSS REFERENCE TO RELATED APPLICATIONS

This application is a Continuation-In-Part of co-pending application Ser. No. 11/847,257 filed on Aug. 29, 2007, which claims the benefit of priority from provisional applications Ser. No. 60/823,855 filed Aug. 29, 2006, Ser. No. 60/823,857 filed Aug. 29, 2006, Ser. No. 60/823,860 filed Aug. 29, 2006, Ser. No. 60/823,864 filed Aug. 29, 2006, Ser. No. 60/823,866 filed Aug. 29, 2006, Ser. No. 60/823,869 filed Aug. 29, 2006, all of which are hereby incorporated by reference.

TECHNICAL FIELD

Described is a device for dispensing fluid material. In particular, the disclosure relates to dispensing spreadable foodstuffs and non-food, liquid, semi-solid or gelatinous substances from a container without the need of a knife or other utensils not part of the packaging.

BACKGROUND

Spreadable foodstuffs and non-food, liquid, semi-solid or gelatinous substances, as packaged currently, require opening at least one package, then using an external device such as a knife or spreader to remove the contents from the package, and ultimately to spread onto the food item. Applying spreadable foodstuffs such as ketchup, mustard, cream cheese, peanut butter, jelly, vegemite, nutella, and the like from conventional packaging requires a great deal of patience, coordination, and is almost assuredly a two-handed affair. Squeezable bottles reduce the need for a device to remove the contents from the packaging, but still require an external utensil to spread the contents on the surface. Further, as the contents are consumed the void space inside the squeezable container grows, causing well-known difficulties with such containers such as splatter, unappetizing noise, and poorly mixed contents. Another problem caused by the void space is the adverse affect the air that occupies the space causes to the contents within. Similarly, non-food, liquid, semi-solid or gelatinous substances, require first dispensing into or onto a separate spoon, sponge, brush, a user's hand, or other utensils and tools before use.

Traditional packaging is also challenging for children, elderly persons, persons with disabilities, and physically challenged individuals to use. The utensils used to remove and spread the contents of the packaging must be washed after every minor use, which is a particular inconvenience during such activities as traveling, picnics, and other occasions where typical kitchen amenities, brushes, sponges and other utensils and tools are not present.

Another shortcoming of conventional packaging is the inability to accurately measure the dispensed quantity. Each surface that comes into contact with spreadable foodstuffs retains a small amount on its surface, so precise measurements are difficult to obtain. Measuring cups provide some relief, but very viscous foodstuffs such as peanut butter and cream cheese are difficult to measure this way since an accurate measurement may only be achieved by packing the product, which is messy and causes further measurement inaccuracies. Moreover, once the precise amount is within the measuring cup, the same problems exist in removing the foodstuffs from the measuring cup. A solution to accurate measurement and use of spreadable foodstuffs is particularly pertinent for portion control, dieting, and restaurant settings where consistency is important. The difficulties and inconveniences described above are also found with a variety of non-food, liquid, semi-solid or gelatinous substances.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The subject invention provides for fluid material, including but not limited to spreadable foodstuffs and non-food, semi-solid or gelatinous substances, to be packaged in a container that can include means for spreading the fluid material. The innovative packaging can perform the role of dispensing and spreading, obviating the need for additional utensils to remove the material from their packaging and to spread or apply them onto a surface or to dispense onto a separate utensil or tool before use. Pressure can be applied to a chamber that contains the material, causing expulsion from a strategically placed aperture or apertures located on or near a substantially broad, flat surface that facilitates spreading the material on a surface. The chamber can be deformed or altered to create the pressure, and the change can be maintained between dispensing instances so as to reduce void space in the chamber and thus maintain freshness.

Specific examples of non-food fluid materials includes but is not limited to toothpaste and dental products; shoe polish; paints; cosmetics; nail polish; thick oils; topical medications; emollients; lotions and soaps; sealants; adhesives; lubricants; veterinary and animal maintenance including but not limited to medications, vitamins and grooming solutions; building, plumbing and home maintenance materials including but not limited to caulk, glue, insulation materials and putty; grooming solutions and vitamins; car cleaning solutions and waxes; laundry treatments; hair care products including but not limited to shampoo, conditioners, coloring treatments, hair stiffeners and styling treatments; hair removal treatment and wax; and the like.

In an aspect of the subject innovation, pressure can be applied in the chamber by means of a powered device such as a motor (electric or otherwise), pneumatic equipment, hydraulic equipment. The powered device can include an on/off switch that can be operated by a user to cause dispensing of the contents of the chamber during desired intervals. The switch can be a typical on/off switch, where the current status will persist unless switched by the user, or a biased switch where pressure, power, or other influence from the user is required to maintain the unbiased position. Manual pressure or power can supplement or supplant the powered pressure, and can be assisted by a rotating finger screw, a lever, a pump, a squeezable chamber, and the like.

In another aspect, the subject innovation provides an at least two-part system, where one part contains the foodstuffs or non-food, semi-solid or gelatinous substances, and the other part contains the mechanism that applies the pressure to the chamber. A third part, containing the apertures and the spreading or application surface, can form part of either of the first two parts, or can stand alone. The separate parts can fasten together using any known means. Any one or combination of these parts can be disposable or reusable. Alternatively, the innovative apparatus can be a unitary device that can be reusable and accept refill contents, or disposable and provide one-time use.

A related aspect of the subject innovation provides for a multiplicity of shapes, spreading or application surfaces, aperture arrangements, and aperture shapes. Interchangeable spreading or application surfaces can be chosen for different applications. Among other variables, the viscosity of the dispensed material can affect the choice of spreader or applicator configuration. For a fluid of low viscosity, the apertures can be smaller and more numerous, for example, while a highly viscous fluid such as peanut butter or shoe polish may have fewer, larger holes. In addition, the shape of the dispensed fluid can be altered by the choice of a spreader configuration. The shape of individual apertures can vary, and include shapes such as stars, hearts, and the like; also, the arrangement of a plurality of apertures relative to one another and the spreading surface can be modified to accommodate a desired output. The spreader shape and/or irregular stripe patterns, for example, can be spread by an irregular pattern of apertures on the spreader. In another related aspect, novelty or affinity spreaders can be used, taking the form of an object such as a baseball bat, a cartoon character, a wand, and the like. Also, the apertures themselves, and/or their relative position, can represent, or dispense, an affinity figure.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

The various aspects of the subject innovation are now described with reference to the annexed drawings, wherein like numerals refer to like or corresponding elements throughout. It should be understood, however, that the drawings and detailed description relating thereto are not intended to limit the claimed subject matter to the particular form disclosed. Rather, the intention is to cover all modifications, equivalents, and alternatives falling within the spirit and scope of the claimed subject matter.

The word "exemplary" is used herein to mean serving as an example, instance or illustration. Any aspect or design described herein as "exemplary" is not necessarily to be construed as preferred or advantageous over other aspects or designs. Furthermore, examples are provided solely for purposes of clarity and understanding and are not meant to limit the subject innovation or relevant portion thereof in any manner. It is to be appreciated that a myriad of additional or alternate examples could have been presented, but have been omitted for purposes of brevity. Furthermore, all or portions of the subject innovation may be implemented as a method, apparatus or article of manufacture using standard engineering techniques.

Figure 1:
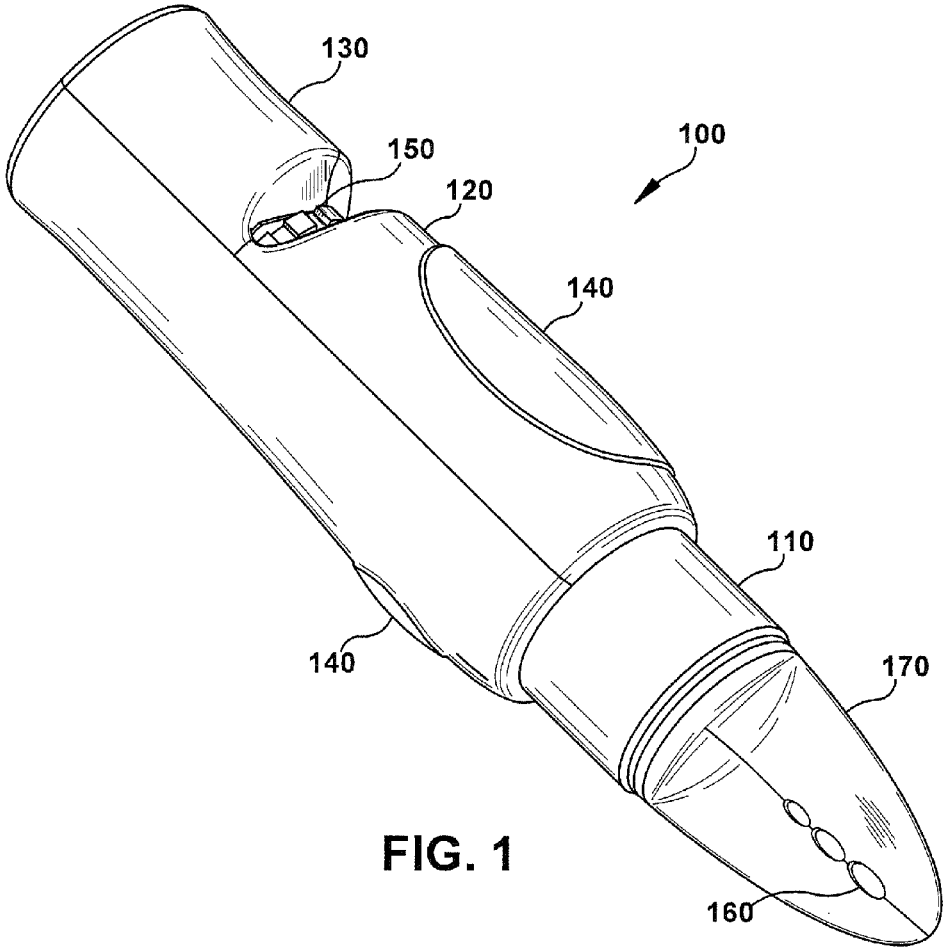
FIG. 1 is an isometric illustration of an apparatus that dispenses fluid material and facilitates spreading or application.

FIG. 1 depicts an apparatus that dispenses and facilitates spreading or application of a fluid material onto a surface. It is to be appreciated that the fluid material and the receiving surface can comprise virtually any fluid material and surface combination, and the principles of the invention can be practiced in any appropriate field where it is advantageous to dispense or spread a fluid material on a surface. The term "fluid" herein connotes the technical definition of fluid: any material that deforms under any shear force. Fluid material may contain objects that are not fluid (e.g., chunky peanut butter, baby food, etc.), or be fluid at certain temperatures or conditions and not others, and still fall within the definition of fluid. The examples used throughout this application are but a small illustration of possible applications of the subject disclosure, and one having ordinary skill in the art will appreciate that the subject innovation is not limited to the examples discussed herein.

Apparatus 100 is an apparatus that dispenses fluid material and facilitates spreading or application of the material on a surface. In an aspect, the apparatus 100 is a hand-held device that dispenses edible fluid material onto another edible surface (e.g., butter, spread on bread). In another aspect, the apparatus 100 is a hand-held device that dispenses non-food, liquid, semi-solid or gelatinous substances onto an appropriate surface. Apparatus 100 can comprise a unitary, one-piece construction, or can be composed of a plurality of connectable parts that can be fastened together. A chamber 110 can contain the fluid material which is to be dispensed from the apparatus 100 and spread onto a surface. It is to be noted that in the aspect where Apparatus 100 can be fastened together from a plurality of connectable parts, the chamber 110 can be rapidly changed or exchanged for a different chamber 110 that may contain a different product. For example, chamber 110 can contain butter or another substance that is to be spread onto a slice of bread for consumption and subsequently chamber 110 can be rapidly replaced with a chamber 110 containing toothpaste for application to teeth. Chamber 110 can be constructed of a flexible material, and can be deformed under pressure to cause the material within to exit the chamber and eventually reach the target surface. Chamber 110 can include graduation markings and a transparent portion to permit inspection of the contents of the chamber and the quantity remaining within the chamber. Alternatively, the chamber 110 can comprise a more rigid material with a plunger at the base which can be driven toward a distal end of the apparatus 100 to cause expulsion of the contained material. In the case of a multi-part composition of apparatus 100, chamber 110 can be constructed to contain a set amount of material, and when the material is exhausted a new chamber 110 containing a fresh supply of material can be introduced and used. In the case of a unitary construction, the entire apparatus can be discarded once the material in the chamber 110 is spent. In this case, it can be desirable to construct the apparatus 100 of a more inexpensive construction, as will be more fully described below.

Apparatus 100 also can include a body 120 which comprises the main housing for internal components. In an aspect, body 120 comprises a sleeve-like construction which can receive a chamber 110. Body 120 can also serve as the primary means for holding the apparatus 100, and as such can be ergonomically shaped, and be constructed of a material pleasing to the touch, and can take an attractive shape and size. A base portion 130 can include a substantially flat bottom surface to facilitate placing the apparatus on a flat surface in a stable manner. Base portion 130 can also house any electrical components and/or a motor or other power source adapted to create pressure on the contents of the chamber 110 to expel the material from the chamber. Alternatively, base portion 130 can also house any mechanically stored energy or spring driven components adapted to create pressure on the contents of the chamber 110 to expel the material from the chamber. A grip portion 140 can accommodate a user's thumb or other part of the hand to facilitate confident grasping of the apparatus. Further, grip portion 140 can include a depressible button that can operate some component of the apparatus 100, such as the mechanism for creating pressure on the contents of the chamber 110. Such a button can be located in any convenient location on the apparatus 100, and can comprise virtually any appropriate mechanism (biased or otherwise) such as a lever, a switch, a button, a knob, a handle, and the like. For purposes of brevity, this aspect will be described herein as a biased, depressible button.

In order to supplement (or, in an aspect, supplant) the operation of the power source, a manually rotatable wheel 150 can be employed to create pressure or relive manual pressure on the contents of the chamber. This wheel 150 can be recessed below the surface of the body 120 to ensure that only deliberate action by the user will cause rotation. An errant hand motion is unlikely to turn the wheel 150 and perhaps disrupt smooth operation of the apparatus, while intentional access to the wheel 150 is not hampered. It is to be appreciated that a wheel configuration as shown is only one of many possible means for creating manual pressure, and the subject innovation is not limited to the examples shown and described in any way.

Pressure in the chamber 110 can cause the material inside the chamber 110 to exit the apparatus 100 through an aperture 160 (or apertures) in the spreading portion 170. Once the material has exited the spreading or application portion 170 through the apertures 160, the spreading or application portion can facilitate spreading of the material onto a surface. In the aspect shown, spreading portion 170 comprises a broad, relatively flat surface that can adequately spread the material onto the surface. However, the spreading or application portion 170 can comprise virtually any shape and aperture configuration 160 to accommodate the material to be dispensed, and the surface onto which the material will be spread or applied. In the multi-part aspect mentioned above, the spreading or application portion 170 can be a separate part, which can be fastened to the remainder of the apparatus 100, and as such can be chosen for different materials, surfaces, and applications. In the case of a unitary construction, the shape and aperture arrangement of the spreading portion 170 can be chosen appropriately as well, depending on several variables including viscosity and make-up of the material, the type of surface that receives the material, and so forth.

Figure 2:
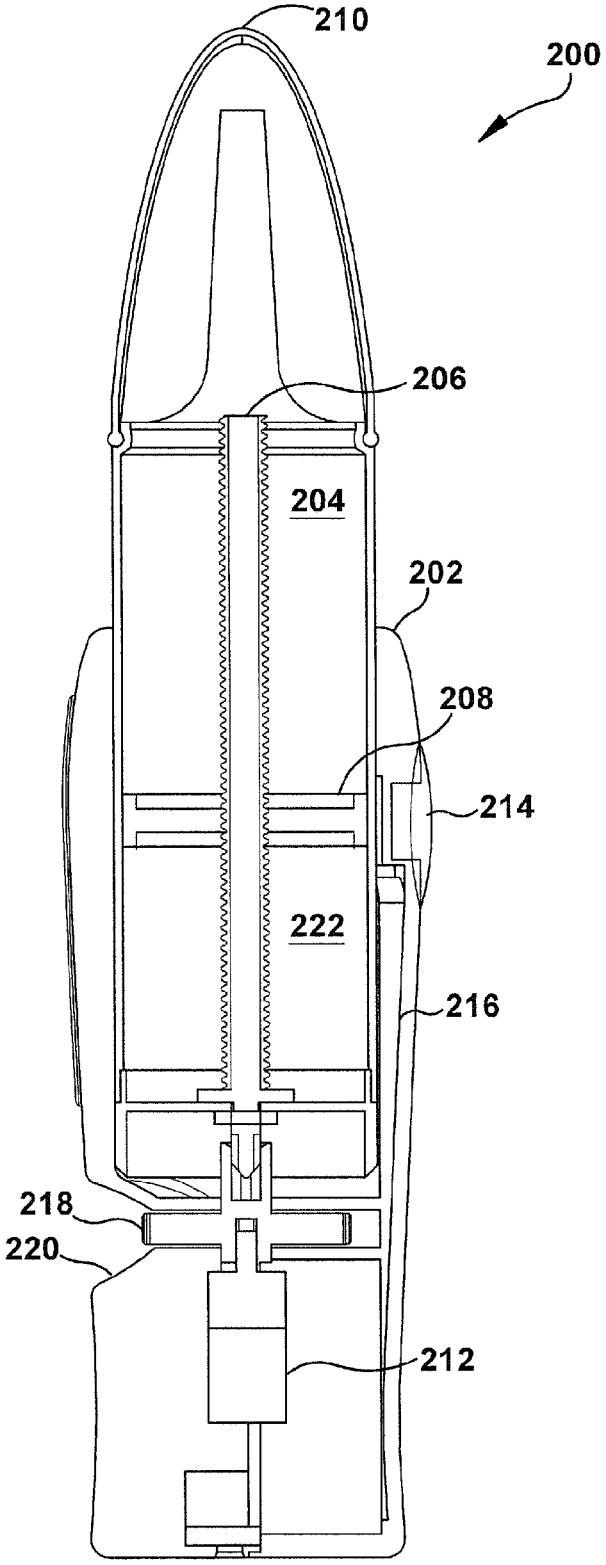
FIG. 2 is an internal view of an apparatus that dispenses fluid material and facilitates spreading. A threaded member and plunger assembly is shown in conjunction with a power source used to create pressure on the fluid material, causing expulsion from the apparatus.

FIG. 2 depicts an internal view of an apparatus 200 that can dispense a fluid material and facilitate spreading or application of the material on a surface. Body 202 can serve as the handling portion of the apparatus 200, and thus can be shaped and sized in an ergonomic, attractive manner. Chamber 204 can contain the fluid material to be dispensed; chamber 204 can itself be housed within body 202. In the example shown, body 202 and chamber 204 are coaxially related, and are substantially cylindrical in shape. However, it is to be appreciated that a multitude of shapes can be employed to house a chamber within a body without departing from the scope or spirit of the subject innovation. To dispense the fluid material, pressure can be applied to the material within the chamber 204. This can be accomplished in a variety of ways, one of which is depicted here as a central threaded member 206, a plunger 208, and a mechanism of driving the plunger 208 toward the distal end 210 of the apparatus 200. In this example, the threaded member 206 is rotated by a motor 212. The motor can be powered electrically, or by any other means of creating a torque on the threaded member 208, rotation of which causes plunger 208 to move toward the distal end 210 of the apparatus 200, and expel the material from the chamber 204. The motor 212 can include a microprocessor to control the power output by monitoring variables such as rotation speed, pressure output and the like. A button 214 can be located on the body 202 or other appropriate location which can be in electrical contact with motor 212 by way of a wire 216. Depressing the button 214 can cause an electrical signal to travel to motor 212, engaging the motor 212 to rotate the threaded member 206.

In an aspect, button 214 (in conjunction with other, internal and/or external components) can facilitate metered dispensing of material. A user can determine an amount of material to be dispensed, and enter this information into the apparatus and when the button 214 is depressed, the determined amount is dispensed. The user can input the desired amount by means of a dial or a digital LCD screen (neither shown) in a manner well known in the art. Pressure can be applied continuously or increasingly until the proper amount has been dictated. The apparatus 200 can measure the displacement or deformation of the chamber 204 in order to calculate when a sufficient amount of material has been dispensed. In the example shown, a relatively precise measurement of material can be interpreted directly from the rotations of the threaded member 206. The pitch of the threads, and the volume of the chamber are all the information needed to calculate an accurate quantity as a function of rotations. Depending on the configuration of the chamber and the source of the pressure, there are metrics available to determine the quantity of material dispensed.

Depending on certain variables such as the viscosity of the material in the chamber 204, the shape and arrangement of the exit apertures, the surface to receive the expelled material, and the like, the motor 212 can supply differing levels of pressure to the chamber 204. In the case of a highly viscous material, more power can be drawn from the motor to compensate for the resistance caused by the high viscosity. In addition, a modified gear ratio can be chosen to accommodate a more viscous material; slowing down the rotation, but increasing the torque applied to the material can be a beneficial configuration. In an aspect, a manual power input can be included to supplement or supplant the power from the motor. In the exemplary embodiment shown, a manually rotatable wheel 218, located coaxially with threaded member 206 and motor 212, can be accessed through a recess 220 in the body 202. Turning the wheel can exert the same force upon the chamber 204 as caused by the motor 212, and can be used to assist the motor if the material does not flow uniformly or as desired. The recess 220 can serve to ensure that only deliberate efforts to rotate the wheel 218 will cause rotation thereof, while not significantly obstructing access to the wheel 218. In an aspect, the motor can sense when the wheel 218 is being rotated by a user, and cease operation despite depression of the button 214. In this manner, the user's torque will not interfere with the motor 212, and vice versa. In another aspect, the manual input can supplement the motor's 212 operation, or the motor 212 can be omitted completely, leaving the manual input of power the sole source of pressure used to dispense material.

The above discussion of the motor 212 and wheel 218 are, of course, merely one example of a configuration of the apparatus 200 according to the subject disclosure. As will be appreciated by one having ordinary skill in the art, there are myriad equivalent sources of power that can be used to create the necessary pressure to dispense the material from chamber 204. The pressure application mechanism can include a pneumatic pressure source brought into communication with the chamber 204, and an increase in the pneumatic pressure can cause the material in the chamber 204 to be dispensed. The pneumatic pressure can be created by a motor located at the base of apparatus 200 (much like motor 212) or can be supplied through a hose or tube connected with an external source of pneumatic pressure, as is well known in the art. Hydraulic pressure can be employed in substantially the same manner as pneumatic pressure. Moreover, pressure can be created by squeezing the chamber 204 transversely, deflecting the side walls inward. Any of these approaches to creating pressure in the chamber can be powered by an internal power source (e.g., battery, fuel cell) or by manual exertion by the user.

In another aspect of the subject disclosure, the material inside the chamber 204 is kept from excessive contact with external elements such as air, by reducing the internal dimensions of the chamber 204 eliminates or substantially reduces the amount of void space within the chamber. In contrast, a conventional packaging arrangement creates void space equal in volume to the product dispensed from the packaging (e.g., mustard bottles, cream cheese tubs, jelly bottles, nail polish, paint), severely damaging product freshness. Further, non-food, semi-solid or gelatinous substances may react with water and oxygen from the atmosphere causing delirious effects. To mitigate this situation, as plunger 208 moves toward the distal end 210 of apparatus 200, void space 222 behind plunger 208 is kept out of contact with the material.

Figure 3:
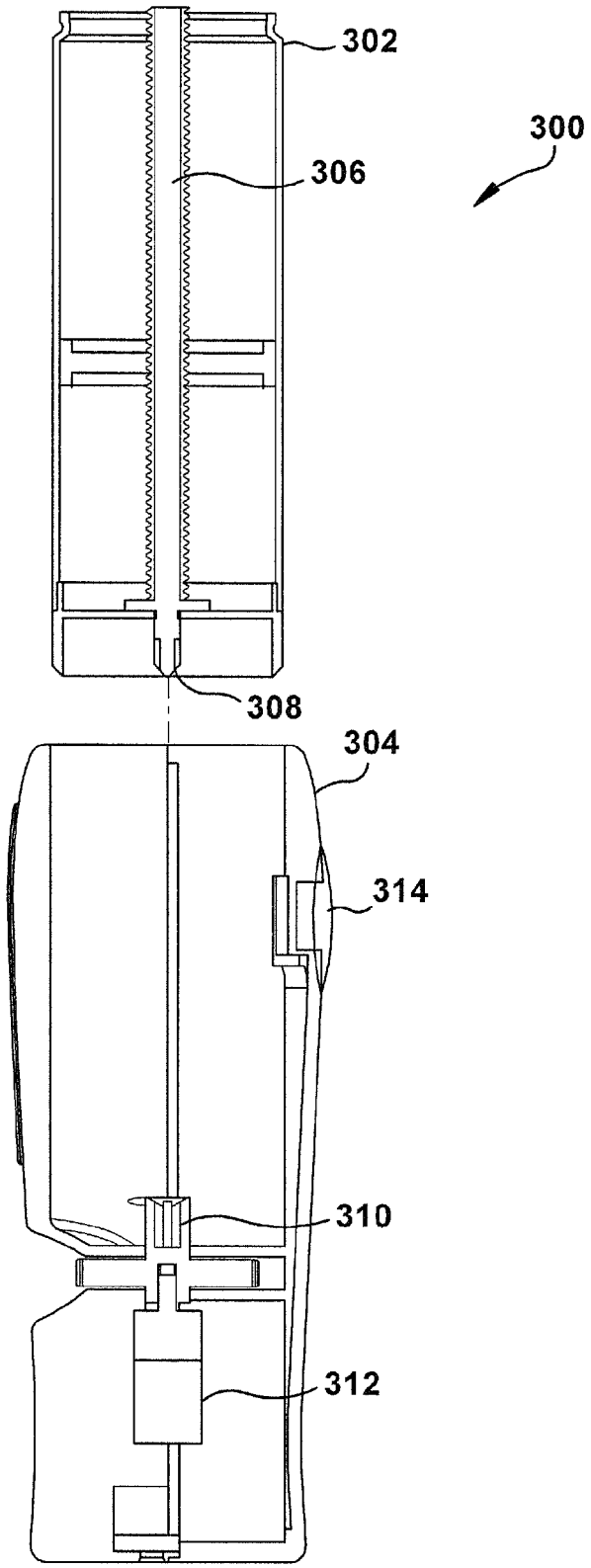
FIG. 3 is an exploded view showing a cartridge containing fluid material and a body that receives the cartridge.

FIG. 3 depicts interaction of two components that make up an apparatus 300 that dispenses fluid material and facilitates spreading or application the material. As described above, the apparatus 300 can be formed of a unitary construction, designed for a single use. The embodiment shown in FIG. 3, however, shows a multi-component configuration, where sub-components can fasten together to form the apparatus 300. Cartridge 302 can be shaped to fit within body 304, and be secured by a snap-mechanism, a friction fit, a threaded engagement, a vacuum seal, or any other equivalent fastening mechanism as is known in the art. Cartridge 302 can serve as the chamber containing the fluid material, as described above with respect to FIGS. 1 and 2. In addition, cartridge 302 can contain a liner (not shown) made of more flexible material that houses the fluid material and is deformed under pressure to expel its contents as desired. In an aspect, body 304 can be constructed for relative long-term use, and can receive a plurality of cartridges 302, which can be disposable. Threaded member 306, shown here as part of the cartridge 302, can also form part of the body 304 and can include a keyed portion 308 that interacts with a corresponding surface 310 on the body 304. Their interaction can serve as the mechanism of delivering power from the motor 312 (or other power source) to the contents of the cartridge 302. A button 314 can be adapted to release the cartridge 302 from the body 304 for disposal. Although not shown, a mechanical stored energy device such as a spring can deliver power to the contents of the cartridge 302.

Figure 4A:
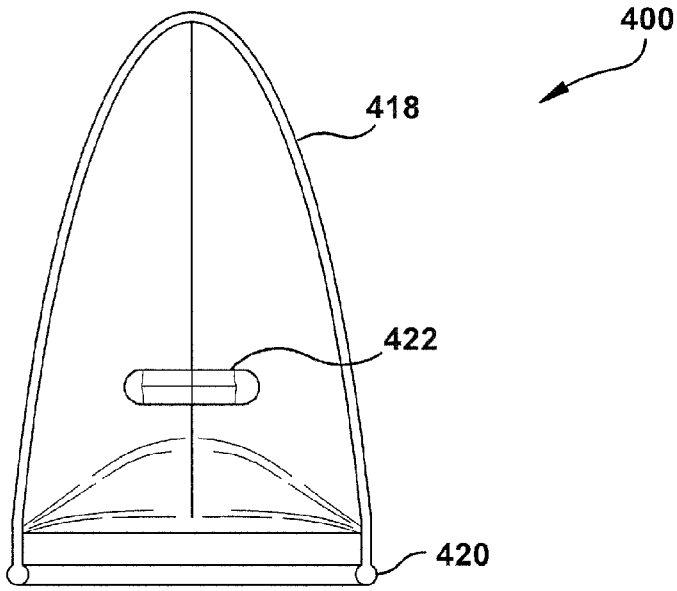
FIGS. 4A-4C are depictions of embodiments of a spreading portion and cap. Apertures and a spreading or application surface are shown.
Figure 4B:
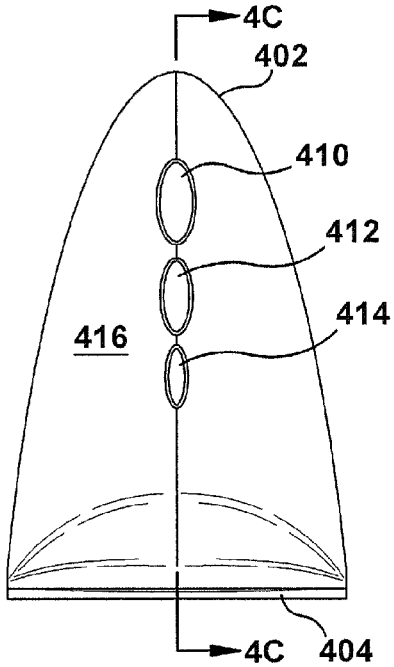
Figure 4C:
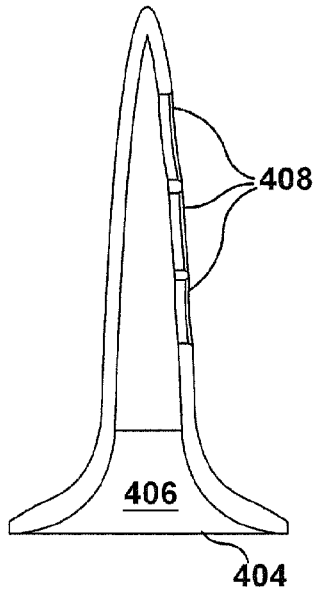
Figure 5A:
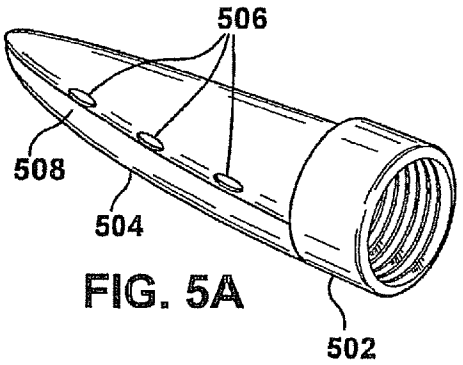
FIGS. 5A-5E are renderings of a plurality of applicator tips that can be used in conjunction with the dispensing or application apparatus, each with different shape and configuration of spreading or application portion and apertures.
Figure 5B:
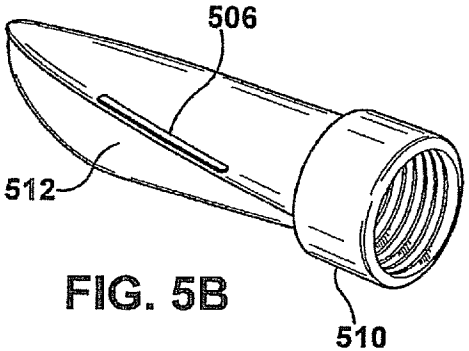
Figure 5C:
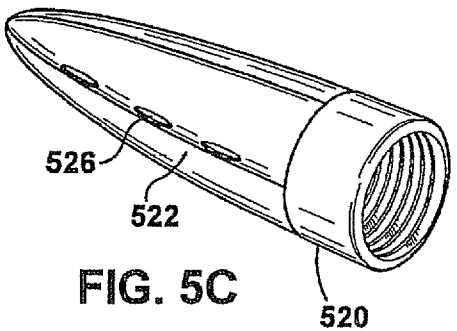
Figure 5D:
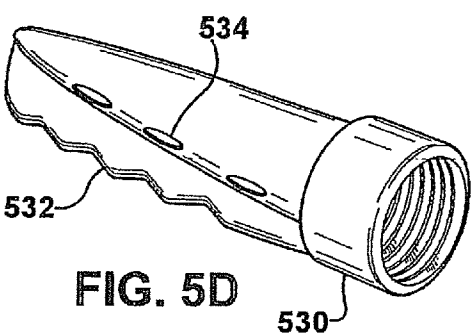
Figure 5E:
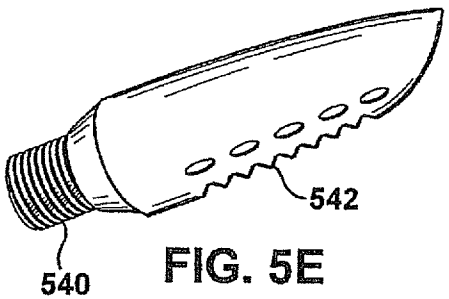
Figure 6A:
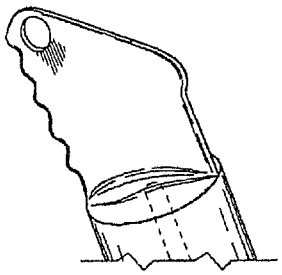
FIGS. 6A-6F are a group of applicator tips that can be used with the dispensing or application apparatus.
Figure 6B:
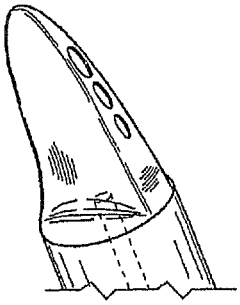
Figure 6C:
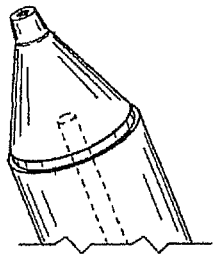
Figure 6D:
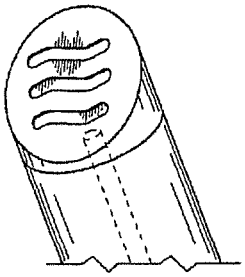
Figure 6E:
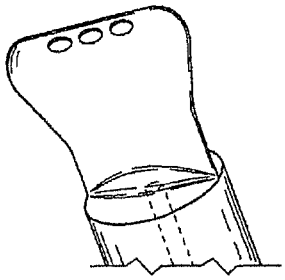
Figure 6F:
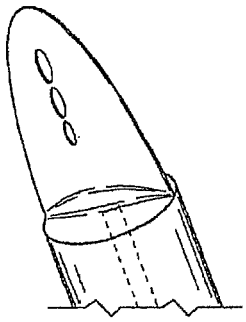
Figure 7A:
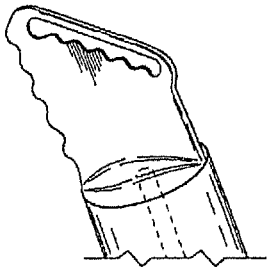
FIGS. 7A-7F are a group of applicator tips that can be used with the dispensing or application apparatus.
Figure 7B:
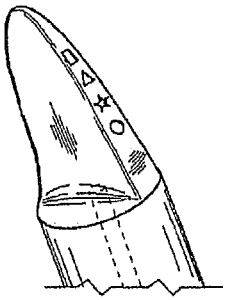
Figure 7C:
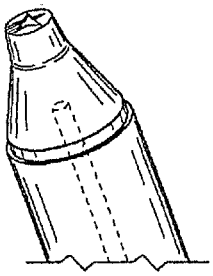
Figure 7D:
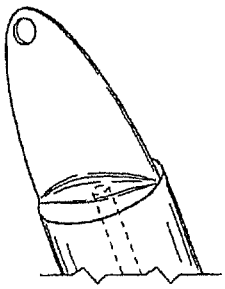
Figure 7E:
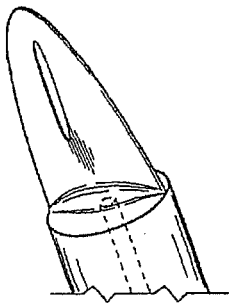
Figure 7F:
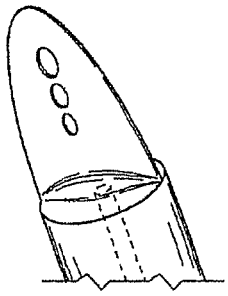

FIG. 4 depicts a spreader or application portion 400 in greater detail. The spreader or application portion 402 can be fastened to the cartridge shown in FIG. 3, or to the distal end of the apparatus shown in FIGS. 1 and 2. In the case of a unitary construction, the spreader or application portion 402 can form part of the assembly. In any case, this portion can operate to dispense the fluid material and facilitate spreading or application of the material onto a surface. The bottom edge 404 of the spreader or application portion 402 and the recess therein can be brought into communication with the chamber described above. Pressure applied to the material in the chamber can cause the material to enter the spreader or application portion 402 in the recessed area 406 and upward until it reaches the apertures 408, where the material exits the apparatus. The design shown here is for exemplary purposes only, and in no way is the subject disclosure limited to the shape, size, or arrangement of the spreader portion 402 or the apertures 408. In this example, aperture 410, located at a greater distance from the source of the pressure below, is larger than apertures 412 and 414 to dispense a uniform amount of material. The dimensions and arrangements of the apertures 408 and the spreader or application portion 402 can be chosen according to principles of fluid dynamics, which are generally well known in the art. In addition, special apertures (not shown) can be implemented to allow for chunky material to be distributed. Materials such as chunky peanut butter with sizable non-fluid peanut pieces, or raspberry preserves with non-fluid seeds, can dictate the use of special apertures that accommodate the non-fluid chunks in the material and distribute as desired.

Spreading or application surface 416 can be constructed as a broad, flat surface that facilitates spreading the fluid material. In the embodiment shown, spreading or application surface 416 resembles a knife—the most common utensil used for spreading—however, any shape or surface can be employed according to the need of a particular application. For instance, the spreading or application surface 416 can be a concave, or a rough, uneven surface, a rounded convex surface, or the shape of a spoon. Further, the spreading or application surface 416 may be formed from a spongy material, a brush or comb suitable for hair. It is to be appreciated that the subject innovation is not limited to the examples shown or described, as will be appreciated by one having ordinary skill in the art. A cap 418 can cover the spreading or application portion 402 and the apertures 408 to maintain freshness. The base portion 420 of the cap 418 can include a friction fit, a snap fit, or a threaded engagement to secure the cap 418 to the spreading portion 402. For ease of removal, a finger ridge 422 can be included.

FIG. 5 shows a plurality of spreading/dispensing portion and aperture shape configurations that can be implemented in accordance with the subject disclosure. For purposes of clear description, each is shown as an applicator tip to an apparatus as described above. It is to be appreciated that each of these applicator tip designs (and their equivalents) can be implemented in a unitary, one-use application of the apparatus as has been disclosed herein. Applicator tip 502 includes a knife edge 504 which can be used to cut as well as to spread. The apertures 506 are placed adjacent to the knife edge 504 to deliver the fluid material directly to the spreading surface 508 of the knife edge 504. Applicator tip 510 shows a slightly larger spreading surface 512 and an elongated aperture 514. As with applicator tip 502, aperture 514 is located near the spreading edge 512. Applicator tip 520 features two edges 522 and 524, with apertures 526 located adjacent only edge 522. Fluid material can be dispensed from the apertures 526 and spread by edge 522, leaving edge 524 free of fluid material for clean cutting, for example. Applicator tip 530 features a broad, serrated edge 532 with dispensing apertures 534 near by, while applicator tip 540 shows a serrated edge 542 with little or no spreading surface. It is to be appreciated that the arrangements and designs of the applicator tips depicted in FIG. 5 are for illustrative purposes only, and the subject disclosure is not limited to the configurations shown here. One having ordinary skill in the art will appreciate that the features of the applicator tips can be implemented in any combination, and that designs not specifically shown here fall within the scope of the subject innovation.

Figure 8:
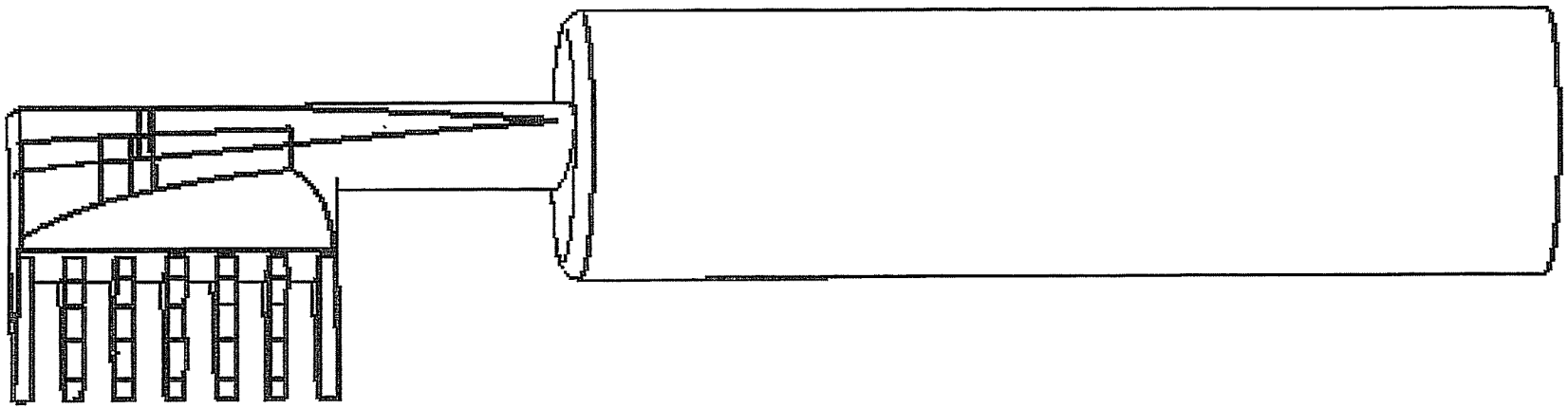
FIG. 8 is an applicator tip that has particular use for application of fluid materials to hair.
Figure 9:
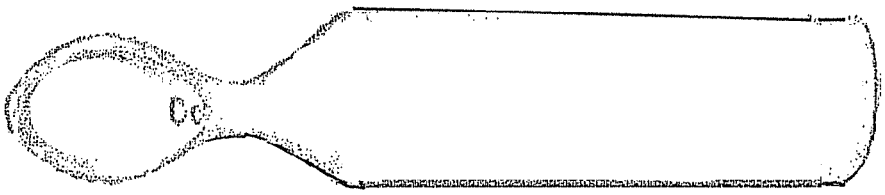
FIG. 9 is an applicator tip taking the form of a spoon.

FIGS. 6 and 7 depict a plurality of different configurations and applicator tips, all of which are contemplated for use with the apparatus as described herein. As with the applicator tips of FIG. 5, it is to be appreciated that the arrangements and designs of the applicator tips here depicted are for illustrative purposes only, and the subject disclosure is not limited in any way to the configurations shown here. One having ordinary skill in the art will appreciate that the features of the applicator tips can be implemented in any combination, and that designs not specifically shown here fall within the scope of the subject innovation. FIG. 8 depicts an applicator tip having the shape of a comb that may be used for application of fluid materials to hair. FIG. 9 depicts an applicator tip having the shape of a spoon.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations thereof are used in either the detailed description or the claims, such terms are intended to be inclusive in a manner similar to the term "comprising" as "comprising" is interpreted when employed as a transitional word in a claim.

What is claimed is:

1. An apparatus for dispensing fluid material comprising:

a chamber that comprises the fluid material, wherein the fluid material is non-food, the chamber having an electric motor and a manual power input;

a disposable cartridge shaped to fit within the chamber and temporarily secured by a fastening mechanism, the disposable cartridge holding the fluid material, the disposable cartridge is comprised within the chamber and extending from one end of the chamber, the disposable cartridge is made of a more flexible material than the chamber and is replaceable;

a pressure applying mechanism attachable to the chamber or has a unitary construction with the chamber and wherein the pressure applying mechanism is powered by at least one of the electric motor, or the manual power input, the pressure applying mechanism applies pressure to the fluid material via a plunger and screw mechanism;

a microprocessor capable of receiving input quantities from a user and controlling the electric motor such that the pressure applying mechanism applies pressure until the quantity is dispensed;

a first depressible button, separate from the pressure applying mechanism, for activating the pressure applying mechanism to apply pressure to the fluid material;

a lever, a switch, a button, a knob, or handle in connection with the fastening mechanism and capable of releasing the disposable cartridge from the chamber;

a dispensing portion having at least one aperture, the dispensing portion placed in fluid communication with the chamber, the pressure causing the fluid material to pass through the at least one aperture, wherein a dimension of the at least one aperture is a function of at least one characteristic of at least one of the fluid material or the receiving surface; and a spreading or application surface located adjacent to the at least one aperture for spreading the fluid material on a receiving surface.

2. The apparatus of claim 1, wherein the fluid material comprises a liquid, semi-solid, or gelatinous substance selected from one or more of dental products; shoe polish; paints; cosmetics; nail polish; thick oils; topical medications; emollients; lotions and soaps; sealants; adhesives; lubricants; veterinary and animal maintenance; caulk; glue; insulation materials; putty; grooming solutions;

vitamins; car cleaning solutions; waxes; laundry treatments; hair care products; and hair removal treatment.

3. The apparatus of claim 1, the chamber is constructed of a flexible material and the pressure deforms the chamber to dispense the fluid material.

4. The apparatus of claim 1, wherein the pressure applying mechanism, applies pressure to the disposable cartridge.

5. The apparatus of claim 1, the pressure is at least one of mechanical, pneumatic, or hydraulic pressure.

6. The apparatus of claim 1, the rotation of the screw causes the chamber to constrict.

7. The apparatus of claim 1, wherein the pressure applying mechanism receive power from an electric motor, and the electric motor receives supplemental power from a manual power input.

8. The apparatus of claim 1, wherein the at least one characteristic of at least one of the fluid material is viscosity or thickness of the fluid material.

9. The apparatus of claim 1, the spreading or application surface is one or more of a knife, a concave surface, a rough or uneven surface, a rounded convex surface, the shape of a spoon, formed from a spongy material, and a brush or comb suitable for application to hair.

10. A method of dispensing a fluid material, comprising:

selecting an amount of fluid material to be dispensed;

creating pressure, via a pressure applying mechanism powered by at least one of an electric motor or a manual power input, the electric motor is actuated by a depressible button, separate from the pressure applying mechanism, in a chamber containing a disposable cartridge shaped to fit within the chamber and secured by a fastening mechanism, the disposable cartridge filled with the fluid material, the disposable cartridge being in fluid contact with a spreading or application portion, the spreading or application portion being attached to the chamber, the spreading or application portion has at least one aperture, wherein a dimension of the at least one aperture is a function of at least one characteristic of at least one of the fluid material or the receiving surface;

dispensing the amount of fluid material; and depositing the fluid material onto a surface, wherein the fluid material is non-food.

11. The method of claim 10, wherein the fluid material comprises a non-food, liquid, semi-solid, or gelatinous substance selected from one or more of dental products; shoe polish; paints; cosmetics; nail polish; thick oils; topical medications; emollients; lotions and soaps; sealants; adhesives; lubricants; veterinary and animal maintenance; caulk; glue; insulation materials; putty; grooming solutions; vitamins; car cleaning solutions; waxes; laundry treatments; hair care products; and hair removal treatment.

12. The method of claim 10, further comprising attaching a spreading or application portion dimensioned to accommodate the fluid material according to at least one characteristic of the fluid material.

13. The method of claim 10, further comprising deforming the chamber to reduce void space in the chamber and reduce space for the disposable cartridge.

14. The apparatus of claim 1, wherein the first depressible button is a switch.

15. The apparatus of claim 1, wherein the pressure applying mechanism applies pressure continuously or increasingly.

16. The apparatus of claim 1, wherein the lever, switch, button, knob, or handle in connection with the fastening mechanism is further located on the chamber.

17. The apparatus of claim 7, wherein the manual power input is a rotatable wheel mechanism.

* * * * *